US011152174B2

(12) United States Patent
Leccia et al.

(10) Patent No.: US 11,152,174 B2
(45) Date of Patent: Oct. 19, 2021

(54) DUAL THOMSON COIL-ACTUATED, DOUBLE-BELLOWS VACUUM CIRCUIT INTERRUPTER

(71) Applicant: Eaton Intelligent Power Limited, Dublin (IE)

(72) Inventors: Brad Robert Leccia, Bethel Park, PA (US); Steven Zhenghong Chen, Coraopolis, PA (US); Tyler Holp, Coraopolis, PA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/902,735

(22) Filed: Jun. 16, 2020

(65) Prior Publication Data

US 2020/0402752 A1 Dec. 24, 2020

Related U.S. Application Data

(60) Provisional application No. 62/863,460, filed on Jun. 19, 2019.

(51) Int. Cl.
*H01H 33/662* (2006.01)
*H01H 33/666* (2006.01)

(52) U.S. Cl.
CPC .. *H01H 33/6662* (2013.01); *H01H 33/66207* (2013.01)

(58) Field of Classification Search
CPC ..... H01H 33/6662; H01H 33/66207; H01H 3/0253; H01H 1/50; H01H 50/20;
(Continued)

(56) References Cited

U.S. PATENT DOCUMENTS 3,026,394 A * 3/1962 Jennings ..... H01H 33/66207 218/118
3,405,245 A * 10/1968 Ito ..... H01H 33/6647 218/126

(Continued)

OTHER PUBLICATIONS

Bini, R et al., "Interruption Technologies for HVDC Transmission: State-of-Art and Outlook", 2017 4th International Conference on Electric Power Equipment—Switching Technology—Xi'an—China, downloaded May 12, 2020.

(Continued)

*Primary Examiner* — William A Bolton
(74) *Attorney, Agent, or Firm* — Fox Rothschild LLP

(57) ABSTRACT

A vacuum interrupter including a first movable contact and electrode contained within a vacuum chamber, a second movable contact and electrode contained within the vacuum chamber, a first actuator operably coupled to the first movable contact, and a second actuator operably coupled to the second movable contact. The vacuum interrupter also includes a first bellows and first bellows plate operably coupled to the first movable electrode, as well as a second bellows and second bellows plate operably coupled to the second movable electrode. Additionally, the vacuum interrupter includes a first pressure chamber located between the first actuator and the vacuum chamber, and a second pressure chamber located between the second actuator and the vacuum chamber.

56 Claims, 2 Drawing Sheets

(58) Field of Classification Search
CPC ..... H01H 50/02; H01H 50/443; H01H 71/24; H01H 33/66238; H01H 2033/66253; H01H 2033/66246; H01H 2033/028; H01H 33/285; H01H 33/666
USPC ..... 218/120, 121, 123, 126, 134, 135, 140, 218/141, 139, 153
See application file for complete search history.

(56) References Cited

U.S. PATENT DOCUMENTS 3,534,304 A 10/1970 Robinson
4,030,055 A 6/1977 Kotos
4,107,496 A * 8/1978 Clason ..... H01H 33/6647 218/126
4,250,363 A * 2/1981 Heberlein ..... H01H 33/664 218/123
4,281,231 A * 7/1981 Griesen ..... H01H 33/664 218/123
6,580,345 B2 6/2003 Akita et al.
6,930,271 B1 8/2005 Palmieri et al.
7,739,058 B2 6/2010 Maruyama
7,829,814 B2 11/2010 Marchand et al.
8,680,956 B2 3/2014 Kim et al.
8,912,871 B2 12/2014 Lauraire et al.
8,982,538 B2 3/2015 Leccia et al.
9,165,726 B2 * 10/2015 Dohnal ..... H01H 9/0038
9,183,996 B2 * 11/2015 Karlstrom ..... H01H 1/50
9,196,439 B2 * 11/2015 Gentsch ..... H01H 33/666
9,396,896 B2 7/2016 Chen et al.
9,431,184 B2 8/2016 Lee et al.
9,478,383 B2 10/2016 Lee et al.
9,508,514 B2 11/2016 Ohda et al.
9,741,513 B2 * 8/2017 Schmitz ..... H01H 33/66238
9,842,713 B2 12/2017 Yu et al.
10,325,737 B2 6/2019 Woo et al.
10,580,599 B1 3/2020 Wang et al.
2012/0274428 A1 11/2012 Reuber et al.
2017/0154747 A1 6/2017 Bissal et al.
2017/0352507 A1 * 12/2017 Kim ..... H01H 33/285
2020/0075274 A1 3/2020 Park et al.

OTHER PUBLICATIONS

Pei, X. et al., "Fast operating moving coil actuator for a vacuum", IEEE Transactions on Energy Conversion, 32(3), 931-940, 2017.

* cited by examiner

DUAL THOMSON COIL-ACTUATED, DOUBLE-BELLOWS VACUUM CIRCUIT INTERRUPTER

RELATED APPLICATIONS AND CLAIM OF PRIORITY

This patent document claims priority to U.S. Provisional Patent Application No. 62/863,460, filed Jun. 19, 2019, the disclosure of which is fully incorporated into this document by reference.

BACKGROUND

Circuit breakers, sometimes referred to as circuit interrupters, include electrical contacts that connect to each other to pass current from a source to a load. The contacts may be separated in order to interrupt the delivery of current, either in response to a command or to protect electrical systems from electrical fault conditions such as current overloads, short circuits, and low voltage level conditions.

Opening the contacts in a circuit breaker can create an arc. To avoid this result, circuit breakers may use an insulated gas, oil, or a vacuum chamber in order to extinguish the current and the arc. Vacuum interrupters include a separable pair of contacts positioned within an insulated and hermetically sealed vacuum chamber. The chamber is contained within a housing. Typically, one of the contacts is moveable and the other is fixed with respect to the housing, although in some vacuum interrupters both contacts may be moveable.

In certain circuits, such as medium voltage direct current (DC) circuits, it is desirable to have a vacuum interrupter in which the contacts move with a fast opening speed. In order to maintain the pair of contacts in a closed (i.e., contacting) state during operation, typical vacuum interrupters have utilized a compression spring positioned in-line with one or both moving stems of the contacts so as to provide adequate force to keep the contacts closed and avoid overheating of the vacuum interrupter. However, while the use of compression springs may effectively provide the force necessary to close the contacts, these springs detrimentally delay the opening of the contacts when needed. That is, the compression springs must first be uncompressed before the contacts are capable of moving to provide an adequate gap for circuit interruption. This delay in the opening of the contacts is particularly disadvantageous in medium voltage direct current (DC) circuits requiring ultra-fast switching capability.

Accordingly, this document describes methods and systems that are intended to address some or all of the problems described above.

SUMMARY

In accordance with an aspect of the disclosure, a vacuum interrupter is disclosed. The vacuum interrupter may include a first movable contact contained within a vacuum chamber, as well as a second movable contact contained within the vacuum chamber. The first moveable contact is connected to a first moveable electrode, and the second contact is connected to a second moveable electrode. A first actuator operably coupled to the first movable electrode, and a second actuator operably coupled to the second movable electrode may also be included. The vacuum interrupter may further include a first bellows and first bellows plate operably coupled to the first movable electrode, as well as a second bellows and second bellows plate operably coupled to the second movable electrode. A first pressure chamber may be located between the first actuator and the vacuum chamber, and a second pressure chamber may be located between the second actuator and the vacuum chamber.

According to another aspect of the disclosure, a vacuum interrupter is disclosed. The vacuum interrupter may include a first movable contact contained within a vacuum chamber, as well as a second movable contact contained within the vacuum chamber. The first moveable contact is connected to a first moveable electrode, and the second contact is connected to a second moveable electrode. A first Thomson coil may also be provided, wherein the first Thomson coil, when energized, is configured to move the first movable electrode in a first direction. A second Thomson coil may further be provided, wherein the second Thomson coil, when energized, is configured to move the second movable contact in a second direction opposite the first direction. The vacuum interrupter may also include a first bellows and first bellows plate operably coupled to the first movable electrode, and a second bellows and second bellows plate operably coupled to the second movable electrode. A first pressure chamber may be located between the first Thomson coil and the vacuum chamber, and a second pressure chamber may be located between the second Thomson coil and the vacuum chamber.

DETAILED DESCRIPTION

Figure 1:
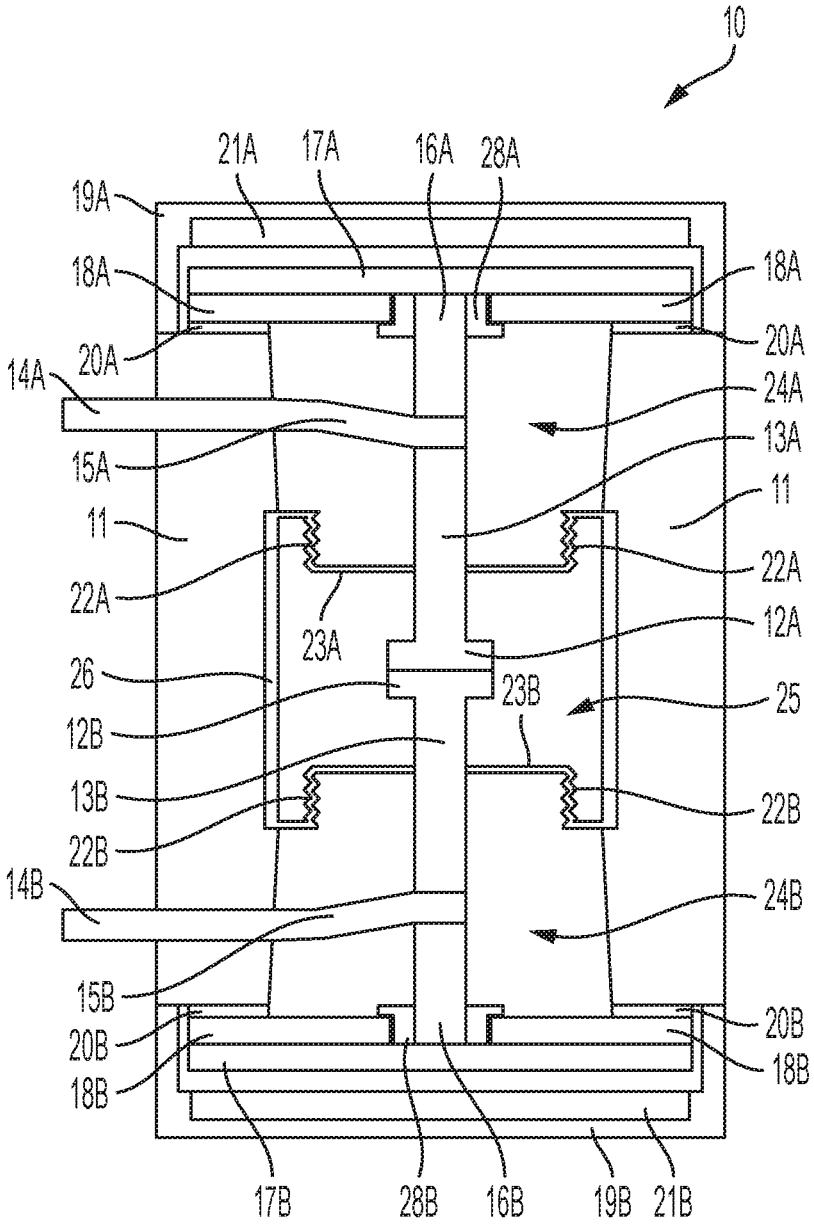
FIG. 1 illustrates a longitudinal cross-sectional view of a vacuum interrupter in a first position in accordance with an aspect of the disclosure.

"Medium voltage" (MV) systems include electrical systems that are rated to handle voltages from about 600 V to about 1000 kV. Some standards define MV as including the voltage range of 600 V to about 69 kV. (See NECA/NEMA 600-2003). Other standards include ranges that have a lower end of 1 kV, 1.5 kV or 2.4 kV and an upper end of 35 kV, 38 kV, 65 kV or 69 kV. (See, for example, IEC 60038, ANSI/IEEE 1585-200 and IEEE Std. 1623-2004, which define MV as 1 kV-35 kV.) Except where stated otherwise, in this document the term "medium voltage" is intended to include the voltage range from approximately 1 kV to approximately 100 kV, as well as all possible sub-ranges within that range, such as approximately 1 kV to approximately 38 kV.

As used in this document, the singular forms "a," "an," and "the" include plural references unless the context clearly dictates otherwise. Unless defined otherwise, all technical and scientific terms used in this document have the same meanings as commonly understood by one of ordinary skill in the art. As used in this document, the term "comprising" (or "comprises") means "including (or includes), but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a direction in which those components are so oriented with respect to each other. The relative orientations of the components may be reversed, or the components may be on the same plane, if the orientation of the structure that contains the components is changed. The claims are intended to include all orientations of a device containing such components.

In this document, the terms "coupled" or "operatively coupled," when referring to two or more physical structures, means that the elements are physically connected so that operation (i.e., movement) of one structure will cause the other structure to responsively move. Operatively coupled structures may be physically connected to each other, or they may be indirectly connected via one or more intermediate structures.

In this document, the term "electrically connected," when referring to two electrical components, means that a conductive path exists between the two components. The path may be a direct path, or an indirect path through one or more intermediary components.

Figure 2:
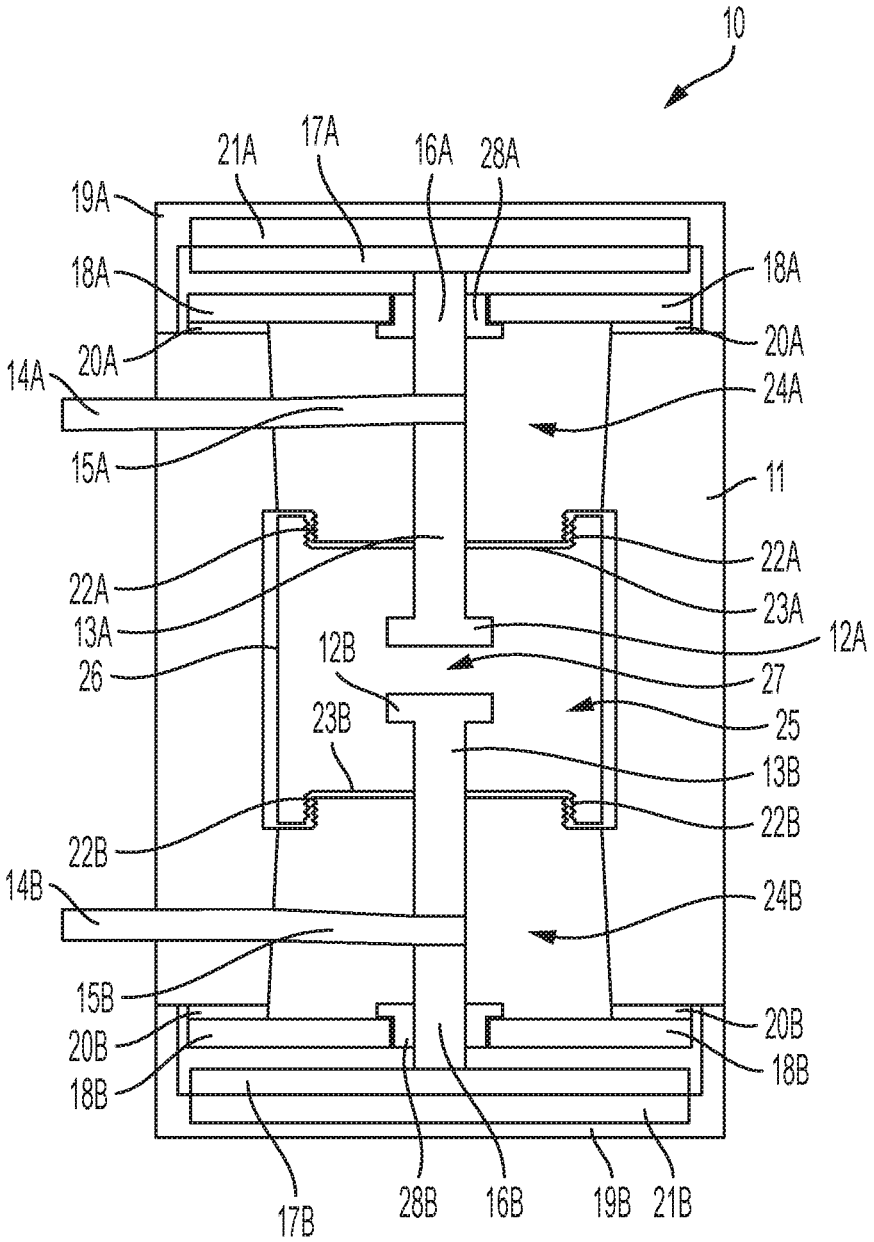
FIG. 2 illustrates a longitudinal cross-sectional view of the vacuum interrupter of FIG. 1 in a second position.

Referring to FIGS. 1-2, longitudinal cross-sectional views of example components of a vacuum interrupter 10 in accordance with an aspect of the disclosure are shown. As is evident from FIGS. 1-2, and as will be set forth in further detail below, the vacuum interrupter 10 is symmetrically designed such that the vacuum interrupter 10 utilizes a pair of movable contacts 12A, 12B, with each movable contact 12A, 12B being actuated by substantially identical componentry.

In one embodiment, the vacuum interrupter 10 includes an insulation layer 11, which substantially surrounds both a vacuum chamber 25 and two pressure chambers 24A, 24B formed within the vacuum interrupter 10. A pair of cover plates 19A, 19B may be positioned at respective ends of the insulation layer 11, thereby forming the substantially sealed internal environment within the vacuum interrupter 10. The pair of contacts 12A, 12B may each be coupled to respective movable electrodes (contact stems) 13A, 13B, with each electrode 13A, 13B being coupled to a respective connector 14A, 14B, which extend through the insulation layer 11 for connection to an external load (not shown). Each connector 14A, 14B may be coupled to a respective electrodes 13A, 13B by way of a respective flexible shunt 15A, 15B. The flexible shunts 15A, 15B are configured to enable both electrodes 13A, 13B (and contacts 12A, 12B) to move bidirectionally, while allowing connectors 14A, 14B to remain stationary. The contacts 12A, 12B, electrodes 13A, 13B, connectors 14A, 14B, and flexible shunts 15A, 15B may be formed of any suitable conductive material(s) such as, e.g., copper, a copper alloy, etc.

In the configuration shown in FIG. 1, the contacts 12A, 12B are shown as being in a connected (or closed) position, thereby enabling current to pass from connector 14A to connector 14B (or vice versa) through the electrodes 13A, 13B to the contacts 12A, 12B. Alternatively, in the configuration shown in FIG. 2, the contacts 12A, 12B may be separated (or opened) to form a gap 27, which interrupts and/or prevents current from passing between the contacts 12A, 12B.

As noted above, each of contacts 12A, 12B is configured as a movable contact, and thus each of contacts 12A, 12B is coupled to a respective actuator to allow for the opening and/or closing of the circuit. More specifically, in accordance with one aspect of the disclosure, contacts 12A, 12B may be actuated by way of respective Thomson coils 18A, 18B, and related componentry. As is shown in FIGS. 1-2, electrodes 13A, 13B are coupled to respective non-conductive stems 16A, 16B, which extend through a respective guide bushing 28A, 28B disposed within a central opening of each Thomson coil 18A, 18B. Each non-conductive stem 16A, 16B is further coupled to respective conductive plates 17A, 17B, which are positioned outside of pressure chambers 24A, 24B formed within the vacuum interrupter 10. Each Thomson coil 18A, 18B may be a relatively flat spiral coil that is wound in either a clockwise or counterclockwise direction around a respective non-conductive stem 16A, 16B. The conductive plates 17A, 17B may be in the form of a disc or other structure that are connected to the respective non-conductive stems 16A, 16B (i.e., linkages) to serve as an armature that may drive the non-conductive stems 16A, 16B (and, thus, the contacts 12A, 12B) in opposite directions to an "open" position, as is shown in FIG. 2.

While not shown in FIGS. 1-2, it is to be understood that each Thomson coil 18A, 18B is electrically connected to a driver (or drivers), which may simultaneously energize the Thomson coils 18A, 18B. When the driver energizes the Thomson coils 18A, 18B, the Thomson coils 18A, 18B generate a magnetic force that will repel the conductive plates 17A, 17B away from the respective Thomson coils 18A, 18B. This, in turn, causes the non-conductive stems 16A, 16B to move in opposite directions, thereby also moving the contacts 12A, 12B away from one another to rapidly open the circuit.

In some embodiments, the vacuum interrupter 10 also includes shock absorbers 20A, 20B, each along one side of a respective one of the Thomson coils 18A, 18B, along with shock absorbers 21A, 21B, each along an opposite side of a respective one of Thomson coils 18A, 18B. These shock absorbers 20A, 20B, 21A, 21B may act to dampen any impact-related vibration caused by the movement of conductive plates 17A, 17B away from, and towards, the Thomson coils 18A, 18B. Additionally and/or alternatively, while not shown, the vacuum interrupter 10 may also include a pair of second Thomson coils positioned at or near the locations of shock absorbers 21A, 21B. These second Thomson coils may be utilized to decelerate the conductive plates 17A, 17B as they are forced away from Thomson coils 18A, 18B, thereby dampening any impact between the conductive plates 17A, 17B and the cover plates 19A, 19B or other surfaces within the vacuum interrupter.

As noted above, conventional vacuum interrupters typically utilize a compression spring positioned in-line with one or both moving stems coupled to the contacts so as to provide adequate force to maintain the contacts in a closed position and avoid overheating of the vacuum interrupter. However, in accordance with one aspect of the disclosure, vacuum interrupter 10 includes a pair of dual-motion, bellows 22A, 22B, which obviate the need for any compression spring(s) within the vacuum interrupter 10 to keep the contacts 12A, 12B in a closed position during normal operation. The diameter of each bellows 22A, 22B is larger than that of its respective contact 12A, 12B.

More specifically, bellows 22A, 22B are formed on opposing ends of a ceramic insulator 26 in order to form a vacuum chamber 25 to house contacts 12A, 12B in a sealed environment. The bellows 22A, 22B may be formed of any suitable material such as, e.g. stainless steel. Unlike conventional bellows used in most vacuum interrupters, though, which may include a bellows plate (or plates) that are generally insignificantly larger in diameter than the diameter of the contacts, bellows 22A, 22B include respective enlarged bellows plates 23A, 23B which are larger than (for example, from approximately 1.5 to 10 times larger than) the diameter of electrodes 13A, 13B. This increased surface area of enlarged bellows plates 23A, 23B provides for increased contact pressure (e.g., 400 lbs. per contact) on the contacts 12A, 12B, which may provide sufficient inwardly-directed force on each of the bellows 22A, 22B so as to maintain contacts 12A, 12B in a "closed" configuration during normal operation of the vacuum interrupter 10. Thus, vacuum interrupter 10 does not require the use of compression springs(s) to maintain the contacts 12A, 12B in a "closed" configuration.

In some embodiments, the contact pressure on the bellows plates 23A, 23B may simply be atmospheric pressure from each respective pressure chamber 24A, 24B. However, in alternative embodiments, pressure chambers 24A, 24B may be filled with a pressurized dry gas (e.g., nitrogen), thereby providing an even greater contact pressure on bellows plates 23A, 23B to maintain the contacts 12A, 12B in a "closed" position, as shown in FIG. 1. While not shown in FIGS. 1-2, the insulation layer 11 and/or cover plates 19A, 19B may be equipped with one or more valves and/or other fittings so as to allow for the injection and/or release of pressurized gas within the pressure chambers 24A, 24B.

Referring to FIG. 2, when a fault condition is detected and interruption of the circuit is needed, the Thomson coils 18A, 18B are simultaneously energized, thereby forcing the conductive plates 17A, 17B in opposite directions to separate the contacts 12A, 12B, forming the gap 27. The bellows plates 23A, 23B are each coupled to a respective electrode 13A, 13B such that movement of the electrodes 13A, 13B in either direction consequently compresses or decompresses the bellows 22A, 22B. However, unlike conventional compression springs used to maintain a closed condition between the contacts, the bellows 22A, 22B do not significantly delay the opening of the contacts 12A, 12B when a fault condition is detected, thereby enabling vacuum interrupter 10 to operate as a fast-acting switch ideal for use in DC applications.

Additionally and/or alternatively, while not shown in FIGS. 1-2, the vacuum interrupter 10 may be positioned in series with one or more conventional (and slower-acting) circuit breakers. With such a configuration, the vacuum interrupter 10 need only operate briefly and temporarily to provide the initial (and fast-acting) interruption in the circuit, allowing the conventional circuit breaker to eventually act as the primary circuit interrupter. For example, when a fault condition is detected, the Thomson coils 18A, 18B of the vacuum interrupter 10 may be energized, opening the contacts 12A, 12B in as little as, e.g., 0.5 ms. However, rather than keeping the Thomson coils 18A, 18B energized to hold the contacts 12A, 12B in an open position for a significant period of time, the system may be configured to energize the Thomson coils 18A, 18B for only a short period of time (e.g., 30 ms), at which point the contacts of the series-connected conventional circuit breaker will have likely opened. Then, at the expiration of this period of time and/or when the contacts of the conventional circuit breaker have opened, the Thomson coils 18A, 18B may be de-energized. At this point, with no latch plate or other mechanism holding the contacts 12A, 12B in an open position, the atmospheric (or greater) pressure on the large surface area of bellows plates 23A, 23B will be sufficient to decompress the bellows 22A, 22B, thereby also moving and maintaining the contacts 12A, 12B in a closed position. In this way, vacuum interrupter 10 may operate as a fast-acting switch, but the components needed to operate in this manner may be simplified and/or reduced because the contacts 12A, 12B need only be opened for a short period of time.

The features and functions described above, as well as alternatives, may be combined into many other different systems or applications. Various alternatives, modifications, variations or improvements may be made by those skilled in the art, each of which is also intended to be encompassed by the disclosed embodiments.

Additionally, the embodiments described above may be used in medium voltage applications, although other applications may be employed.

The invention claimed is:

1. A vacuum interrupter comprising:

a first movable contact contained within a vacuum chamber;

a first movable electrode connected to the first movable contact;

a second movable contact contained within the vacuum chamber;

a second movable electrode connected to the second movable contact;

a first actuator operably coupled to the first movable electrode;

a second actuator operably coupled to the second movable electrode;

a first bellows and first bellows plate operably coupled to the first movable electrode;

a second bellows and second bellows plate operably coupled to the second movable electrode;

a first pressure chamber located between the first actuator and the vacuum chamber; and a second pressure chamber located between the second actuator and the vacuum chamber, wherein the first pressure chamber and the second pressure chamber are filled with a pressurized gas.

2. The vacuum interrupter of claim 1, wherein the first bellows, the first bellows plate, the second bellows, and the second bellows plate are configured to hold the respective first movable contact and the second movable contact in a closed position when the first actuator and the second actuator are not energized.

3. The vacuum interrupter of claim 2, wherein the first bellows plate and the second bellows plate are sized such that pressure from the respective first pressure chamber and the second pressure chamber is sufficient to hold the first movable contact and the second movable contact in the closed position.

4. The vacuum interrupter of claim 3, wherein the first bellows plate has a diameter between 1.5 and 10 times larger than a diameter of the first movable contact, and the second bellows plate has a diameter between 1.5 and 10 times larger than a diameter of the second movable contact.

5. The vacuum interrupter of claim 1, wherein the first actuator comprises a first Thomson coil and the second actuator comprises a second Thomson coil.

6. The vacuum interrupter of claim 5, wherein the first actuator further comprises a first conductive plate operatively coupled to the first movable contact, and further wherein the second actuator comprises a second conductive plate operatively coupled to the second movable contact.

7. The vacuum interrupter of claim 6, wherein the first conductive plate is operatively coupled to the first movable contact by a first non-conductive stem, and further wherein the second conductive plate is operatively coupled to the second movable contact by a second non-conductive stem.

8. The vacuum interrupter of claim 7, wherein the first non-conductive stem passes through the first Thomson coil and the second non-conductive stem passes through the second Thomson coil.

9. The vacuum interrupter of claim 6, further comprising a third Thomson coil and a fourth Thomson coil, wherein the third Thomson coil is configured to decelerate the first conductive plate when the first Thomson coil is energized, and wherein the fourth Thomson coil is configured to decelerate the second conductive plate when the second Thomson coil is energized.

10. The vacuum interrupter of claim 5, further comprising at least one first shock absorber positioned along the first Thomson coil and at least one second shock absorber positioned along the second Thomson coil.

11. The vacuum interrupter of claim 1, wherein the first movable electrode is coupled to a first connector extending outside of the vacuum interrupter, and further wherein the second electrode is coupled to a second connector extending outside of the vacuum interrupter.

12. The vacuum interrupter of claim 11, wherein the first electrode is coupled to the first bellows plate and the second electrode is coupled to the second bellows plate such that movement of the first bellows plate causes corresponding movement of the first electrode and movement of the second bellows plate causes corresponding movement of the second electrode.

13. A vacuum interrupter comprising:

a first movable contact contained within a vacuum chamber;

a first movable electrode connected to the first movable contact;

a second movable contact contained within the vacuum chamber;

a second movable electrode connected to the second movable contact;

a first Thomson coil, wherein the first Thomson coil, when energized, is configured to move the first movable electrode in a first direction;

a second Thomson coil, wherein the second Thomson coil, when energized, is configured to move the second movable contact in a second direction opposite the first direction;

a first bellows and first bellows plate operably coupled to the first movable electrode;

a second bellows and second bellows plate operably coupled to the second movable electrode;

a first pressure chamber located between the first Thomson coil and the vacuum chamber; and a second pressure chamber located between the second Thomson coil and the vacuum chamber, wherein the first pressure chamber and the second pressure chamber are filled with a pressurized gas.

14. The vacuum interrupter of claim 13, wherein the first bellows, the first bellows plate, the second bellows, and the second bellows plate are configured to hold the respective first movable contact and the second movable contact in a closed position when the first Thomson coil and the second Thomson coil are not energized.

15. The vacuum interrupter of claim 14, wherein the first bellows plate and the second bellows plate are sized such that pressure from the respective first pressure chamber and the second pressure chamber is sufficient to hold the first movable contact and the second movable contact in the closed position.

16. The vacuum interrupter of claim 15, wherein the first bellows plate has a diameter between 1.5 and 10 times larger than a diameter of the first movable electrode, and the second bellows plate has a diameter between 1.5 and 10 times larger than a diameter of the second movable electrode.

17. The vacuum interrupter of claim 13, further comprising a first conductive plate operatively coupled to the first movable electrode and a second conductive plate operatively coupled to the second movable electrode, wherein the first Thomson coil, when energized, causes the first conductive plate to move in the first direction and the second Thomson coil, when energized, causes the second conductive plate to move in the second direction.

18. The vacuum interrupter of claim 17, wherein the first conductive plate is operatively coupled to the first movable electrode by a first non-conductive stem that passes through the first Thomson coil, and further wherein the second conductive plate is operatively coupled to the second movable electrode by a second non-conductive stem that passes through the second Thomson coil.

19. A vacuum interrupter comprising:

a first movable contact contained within a vacuum chamber;

a first movable electrode connected to the first movable contact;

a second movable contact contained within the vacuum chamber;

a second movable electrode connected to the second movable contact;

a first actuator operably coupled to the first movable electrode;

a second actuator operably coupled to the second movable electrode;

a first bellows and first bellows plate operably coupled to the first movable electrode;

a second bellows and second bellows plate operably coupled to the second movable electrode;

a first pressure chamber located between the first actuator and the vacuum chamber; and a second pressure chamber located between the second actuator and the vacuum chamber, wherein the first bellows, the first bellows plate, the second bellows, and the second bellows plate are configured to hold the respective first movable contact and the second movable contact in a closed position where the first actuator and the second actuator are not energized.

20. The vacuum interrupter of claim 19, wherein the first bellows plate and the second bellows plate are sized such that pressure from the respective first pressure chamber and the second pressure chamber is sufficient to hold the first movable contact and the second movable contact in the closed position.

21. The vacuum interrupter of claim 20, wherein the first bellows plate has a diameter between 1.5 and 10 times larger than a diameter of the first movable contact, and the second bellows plate has a diameter between 1.5 and 10 times larger than a diameter of the second movable contact.

22. The vacuum interrupter of claim 19, wherein the first actuator comprises a first Thomson coil and the second actuator comprises a second Thomson coil.

23. The vacuum interrupter of claim 22, wherein the first actuator further comprises a first conductive plate operatively coupled to the first movable contact, and further wherein the second actuator comprises a second conductive plate operatively coupled to the second movable contact.

24. The vacuum interrupter of claim 23, wherein the first conductive plate is operatively coupled to the first movable contact by a first non-conductive stem, and further wherein the second conductive plate is operatively coupled to the second movable contact by a second non-conductive stem.

25. The vacuum interrupter of claim 24, wherein the first non-conductive stem passes through the first Thomson coil and the second non-conductive stem passes through the second Thomson coil.

26. The vacuum interrupter of claim 23, further comprising a third Thomson coil and a fourth Thomson coil, wherein the third Thomson coil is configured to decelerate the first conductive plate when the first Thomson coil is energized, and wherein the fourth Thomson coil is configured to decelerate the second conductive plate when the second Thomson coil is energized.

27. The vacuum interrupter of claim 22, further comprising at least one first shock absorber positioned along the first Thomson coil and at least one second shock absorber positioned along the second Thomson coil.

28. The vacuum interrupter of claim 19, wherein the first movable electrode is coupled to a first connector extending outside of the vacuum interrupter, and further wherein the second electrode is coupled to a second connector extending outside of the vacuum interrupter.

29. The vacuum interrupter of claim 28, wherein the first electrode is coupled to the first bellows plate and the second electrode is coupled to the second bellows plate such that movement of the first bellows plate causes corresponding movement of the first electrode and movement of the second bellows plate causes corresponding movement of the second electrode.

30. A vacuum interrupter comprising:

a first movable contact contained within a vacuum chamber;

a first movable electrode connected to the first movable contact;

a second movable contact contained within the vacuum chamber;

a second movable electrode connected to the second movable contact;

a first Thomson coil, wherein the first Thomson coil, when energized, is configured to move the first movable electrode in a first direction;

a second Thomson coil, wherein the second Thomson coil, when energized, is configured to move the second movable contact in a second direction opposite the first direction;

a first bellows and first bellows plate operably coupled to the first movable electrode;

a second bellows and second bellows plate operably coupled to the second movable electrode, a first pressure chamber located between the first Thomson coil and the vacuum chamber; and a second pressure chamber located between the second Thomson coil and the vacuum chamber, wherein the first bellows, the first bellows plate, the second bellows, and the second bellows plate are configured to hold the respective first movable contact and the second movable contact in a closed position when the first Thomson coil and the second Thomson coil are not energized.

31. The vacuum interrupter of claim 30, wherein the first bellows plate and the second bellows plate are sized such that pressure from the respective first pressure chamber and the second pressure chamber is sufficient to hold the first movable contact and the second movable contact in the closed position.

32. The vacuum interrupter of claim 31, wherein the first bellows plate has a diameter between 1.5 and 10 times larger than a diameter of the first movable electrode, and the second bellows plate has a diameter between 1.5 and 10 times larger than a diameter of the second movable electrode.

33. The vacuum interrupter of claim 30, further comprising a first conductive plate operatively coupled to the first movable electrode and a second conductive plate operatively coupled to the second movable electrode, wherein the first Thomson coil, when energized, causes the first conductive plate to move in the first direction and the second Thomson coil, when energized, causes the second conductive plate to move in the second direction.

34. The vacuum interrupter of claim 33, wherein the first conductive plate is operatively coupled to the first movable electrode by a first non-conductive stem that passes through the first Thomson coil, and further wherein the second conductive plate is operatively coupled to the second movable electrode by a second non-conductive stem that passes through the second Thomson coil.

35. A vacuum interrupter comprising:

a first movable contact contained within a vacuum chamber;

a first movable electrode connected to the first movable contact;

a second movable contact contained within the vacuum chamber;

a second movable electrode connected to the second movable contact;

a first actuator operably coupled to the first movable electrode, wherein the first actuator comprises:

a first Thomson coil, and a first conductive plate operatively coupled to the first movable contact by a first non-conductive stem that passes through the first Thomson coil;

a second actuator operably coupled to the second movable electrode, wherein the second actuator comprises:

a second Thomson coil, and a second conductive plate operatively coupled to the second movable contact by a second non-conductive stem that passes through the second Thomson coil;

a first bellows and first bellows plate operably coupled to the first movable electrode;

a second bellows and second bellows plate operably coupled to the second movable electrode;

a first pressure chamber located between the first actuator and the vacuum chamber; and a second pressure chamber located between the second actuator and the vacuum chamber.

36. The vacuum interrupter of claim 30, wherein the first bellows, the first bellows plate, the second bellows, and the second bellows plate are configured to hold the respective first movable contact and the second movable contact in a closed position when the first actuator and the second actuator are not energized.

37. The vacuum interrupter of claim 36, wherein the first bellows plate and the second bellows plate are sized such that pressure from the respective first pressure chamber and the second pressure chamber is sufficient to hold the first movable contact and the second movable contact in the closed position.

38. The vacuum interrupter of claim 37, wherein the first bellows plate has a diameter between 1.5 and 10 times larger than a diameter of the first movable contact, and the second bellows plate has a diameter between 1.5 and 10 times larger than a diameter of the second movable contact.

39. The vacuum interrupter of claim 35, further comprising a third Thomson coil and a fourth Thomson coil, wherein the third Thomson coil is configured to decelerate the first conductive plate when the first Thomson coil is energized, and wherein the fourth Thomson coil is configured to decelerate the second conductive plate when the second Thomson coil is energized.

40. The vacuum interrupter of claim 35, further comprising at least one first shock absorber positioned along the first Thomson coil and at least one second shock absorber positioned along the second Thomson coil.

41. The vacuum interrupter of claim 35, wherein the first movable electrode is coupled to a first connector extending outside of the vacuum interrupter, and further wherein the second electrode is coupled to a second connector extending outside of the vacuum interrupter.

42. The vacuum interrupter of claim 41, wherein the first electrode is coupled to the first bellows plate and the second electrode is coupled to the second bellows plate such that movement of the first bellows plate causes corresponding movement of the first electrode and movement of the second bellows plate causes corresponding movement of the second electrode.

43. A vacuum interrupter comprising:

a first movable contact contained within a vacuum chamber;

a first movable electrode connected to the first movable contact;

a second movable contact contained within the vacuum chamber;

a second movable electrode connected to the second movable contact;

a first Thomson coil, wherein the first Thomson coil, when energized, is configured to move the first movable electrode in a first direction;

a second Thomson coil, wherein the second Thomson coil, when energized, is configured to move the second movable contact in a second direction opposite the first direction;

a first bellows and first bellows plate operably coupled to the first movable electrode;

a second bellows and second bellows plate operably coupled to the second movable electrode;

a first pressure chamber located between the first Thomson coil and the vacuum chamber;

a second pressure chamber located between the second Thomson coil and the vacuum chamber;

a first conductive plate operatively coupled to the first movable electrode by a first non-conductive stem that passes through the first Thomson coil, wherein the first Thomson coil, when energized, causes the first conductive plate to move in the first direction; and a second conductive plate operatively coupled to the second movable electrode by a second non-conductive stem that passes through the second Thomson coil, wherein the second Thomson coil, when energized, causes the second conductive plate to move in the second direction.

44. The vacuum interrupter of claim 43, wherein the first bellows, the first bellows plate, the second bellows, and the second bellows plate are configured to hold the respective first movable contact and the second movable contact in a closed position when the first Thomson coil and the second Thomson coil are not energized.

45. The vacuum interrupter of claim 44, wherein the first bellows plate and the second bellows plate are sized such that pressure from the respective first pressure chamber and the second pressure chamber is sufficient to hold the first movable contact and the second movable contact in the closed position.

46. The vacuum interrupter of claim 45, wherein the first bellows plate has a diameter between 1.5 and 10 times larger than a diameter of the first movable electrode, and the second bellows plate has a diameter between 1.5 and 10 times larger than a diameter of the second movable electrode.

47. A vacuum interrupter comprising:

a first movable contact contained within a vacuum chamber;

a first movable electrode connected to the first movable contact;

a second movable contact contained within the vacuum chamber;

a second movable electrode connected to the second movable contact;

a first actuator operably coupled to the first movable electrode, wherein the first actuator comprises a first Thomson coil and a first conductive plate operatively coupled to the first movable contact;

a second actuator operably coupled to the second movable electrode, wherein the second actuator comprises a second Thomson coil and a second conductive plate operatively coupled to the second movable contact;

a first bellows and first bellows plate operably coupled to the first movable electrode;

a second bellows and second bellows plate operably coupled to the second movable electrode;

a first pressure chamber located between the first actuator and the vacuum chamber;

a second pressure chamber located between the second actuator and the vacuum chamber;

a third Thomson coil configured to decelerate the first conductive plate when the first Thomson coil is energized; and a fourth Thomson coil configured to decelerate the second conductive plate when the second Thomson coil is energized.

48. The vacuum interrupter of claim 47, wherein the first bellows, the first bellows plate, the second bellows, and the second bellows plate are configured to hold the respective first movable contact and the second movable contact in a closed position when the first actuator and the second actuator are not energized.

49. The vacuum interrupter of claim 48, wherein the first bellows plate and the second bellows plate are sized such that pressure from the respective first pressure chamber and the second pressure chamber is sufficient to hold the first movable contact and the second movable contact in the closed position.

50. The vacuum interrupter of claim 49, wherein the first bellows plate has a diameter between 1.5 and 10 times larger than a diameter of the first movable contact, and the second bellows plate has a diameter between 1.5 and 10 times larger than a diameter of the second movable contact.

51. The vacuum interrupter of claim 47, wherein the first conductive plate is operatively coupled to the first movable contact by a first non-conductive stem, and further wherein the second conductive plate is operatively coupled to the second movable contact by a second non-conductive stem.

52. The vacuum interrupter of claim 47, wherein the first non-conductive stem passes through the first Thomson coil and the second non-conductive stem passes through the second Thomson coil.

53. The vacuum interrupter of claim 47, further comprising at least one first shock absorber positioned along the first Thomson coil and at least one second shock absorber positioned along the second Thomson coil.

54. The vacuum interrupter of claim 47, wherein the first pressure chamber and the second pressure chamber are filled with a pressurized gas.

55. The vacuum interrupter of claim 47, wherein the first movable electrode is coupled to a first connector extending outside of the vacuum interrupter, and further wherein the second electrode is coupled to a second connector extending outside of the vacuum interrupter.

56. The vacuum interrupter of claim 55, wherein the first electrode is coupled to the first bellows plate and the second electrode is coupled to the second bellows plate such that movement of the first bellows plate causes corresponding movement of the first electrode and movement of the second bellows plate causes corresponding movement of the second electrode.

* * * * *